US005651664A

United States Patent [19]

Hinds et al.

[11] Patent Number: 5,651,664

[45] Date of Patent: Jul. 29, 1997

[54] "FREE" COIL TUBING DOWNHOLE JET PUMP APPARATUS AND METHOD

[75] Inventors: Aaron Clyde Hinds, Webster, Tex.; David O'Mara, Canyon Country, Calif.

[73] Assignee: Trico Industries, Inc., Huntington Park, Calif.

[21] Appl. No.: 568,458

[22] Filed: Dec. 7, 1995

Related U.S. Application Data

[63] Continuation of Ser. No. 308,600, Sep. 19, 1994, abandoned.

[51] Int. Cl.[6] ..... F04F 5/00

[52] U.S. Cl. ..... 417/172; 417/151; 166/105.6

[58] Field of Search ..... 417/151, 172; 166/105.6, 372

[56] References Cited

U.S. PATENT DOCUMENTS

| | | | |
|---|---|---|---|
| 1,355,606 | 10/1920 | Ingram . | |
| 1,758,376 | 5/1930 | Sawyer . | |
| 2,287,076 | 6/1942 | Zachry . | |
| 2,826,994 | 3/1958 | Slater . | |
| 3,215,087 | 11/1965 | McLeod . | |
| 3,887,008 | 6/1975 | Canfield . | |
| 4,171,016 | 10/1979 | Kempton | 417/172 |
| 4,183,722 | 1/1980 | Roeder . | |
| 4,293,283 | 10/1981 | Roeder . | |
| 4,390,061 | 6/1983 | Short . | |
| 4,603,735 | 8/1986 | Black . | |
| 4,658,893 | 4/1987 | Black . | |
| 4,718,486 | 1/1988 | Black | 417/172 |
| 4,723,890 | 2/1988 | Corteville et al. | 417/172 |
| 4,744,420 | 5/1988 | Patterson et al. | 166/312 |
| 4,790,376 | 12/1988 | Weeks . | |
| 4,844,166 | 7/1989 | Going, III et al. | 166/372 |
| 5,055,002 | 10/1991 | Roeder | 417/172 |
| 5,083,609 | 1/1992 | Coleman . | |
| 5,372,190 | 12/1994 | Coleman | 417/172 |
| 5,374,163 | 12/1994 | Jaikaran | 417/172 |

OTHER PUBLICATIONS

Trico Industries, Inc., 1994–95 catalog, "Taking Care of Business" pp. 2975–2978.

*Primary Examiner*—Timothy Thorpe
*Assistant Examiner*—Ted Kim
*Attorney, Agent, or Firm*—Flehr Hohbach Test Albritton & Herbert LLP

[57] ABSTRACT

A hydraulic pump apparatus (35) for a well assembly (36) including a rigid, elongated tubular casing (37). extending into a formation producing production fluid. The hydraulic pump apparatus (35) including an elongated tube (40) and a bottom-hole assembly (42) mounted to a lower end of the tube (40). The bottom-hole assembly (42) includes an outwardly facing sealing surface (54). A "free" jet pump assembly (55) is included having a pump body (56) formed for sliding receipt in the tube (40) and the pump receiving passage (49). The pump body (56) includes a lower seal (60) mounted to an inwardly facing surface (62) of the jet pump assembly (55) for sealing engagement with the outwardly facing sealing surface (54) of the discharge port (51) to permit discharge of exhausted production fluid from the jet pump assembly (55) through the discharge port (51). The lower seal (60) is supported on the jet pump assembly (55) to shield the lower seal (60) from contact with the tube (40) and the inwardly facing bore sealing surface (46) during sliding receipt of the jet pump assembly (55) in the tube (40) and the bottom-hole assembly (42).

24 Claims, 3 Drawing Sheets

"FREE" COIL TUBING DOWNHOLE JET PUMP APPARATUS AND METHOD

This is a continuation of application Ser. No. 08/308,600 filed Sep. 19, 1994, now abn.

TECHNICAL FIELD

The present invention relates, generally, to "free" downhole hydraulic pump assemblies, and more particularly, relates to "free" jet pump assemblies deployed through coiled tubing and jointed tubing.

BACKGROUND ART

As the demand for natural oil and gas increases, so does the need for efficient retrieval of these limited resources from their subterranean locations. This is especially apparent in economies where the price per barrel of crude oil not infrequently fails to proportionately rise with increased demand. Hence, through an abundance of research and development, the techniques and equipment employed to remove these formation or production fluids have become increasingly sophisticated and efficient.

In atypical oil and gas recovery process, after a well has been drilled, a steel tubular casing, extending the length of the well, is inserted into the well and uncured concrete pumped down the casing. Upon forcing of the concrete out of the bottom of the casing, it fills an annular space between an outer surface of the casing and formation walls of the well, where the concrete cures to firmly anchor the casing to the well walls and seal off the well.

To access the formation fluids through the now sealed well casing, both the casing and the concrete are perforated at a predetermined downhole location below the formation fluid level (and a slurry plug in the casing). These perforations allow the production fluid to enter the well casing from the formation for retrieval. Due to the difference in pressure between the formation and the well casing interior, the inrush of the fluid into the well is substantial enough to clean the perforation passages of any debris for unobstructed passage of production fluid into the casing.

In some regions, such as in the Middle East, sufficient bottom hole pressure, via natural gas, often is available in the formation to force the production fluid to the surface, where it can be collected and utilized for commercial purposes. As the localized natural gas in these drilled formation begins to deplete, gas lifting techniques and associated apparatus are employed which inject gas into the production fluids to assist lifting of them to the surface. This gas injection typically involves inserting a smaller diameter jointed gas lift tube into the well casing. The gas lift tube includes a plurality of perforated gas lift mandrels formed for discharging gas. As the gas passes through the mandrels and into the production fluid in the annulus formed between the casing and the jointed tube, the gas mixes with and is entrained in the production fluid, causing the density, and hence the column fluid weight or gradient, to decrease. This lower weight enables the current, lower, down-hole pressure to lift the production fluids to the surface for collection.

In time, however, water seeps into or permeates the well column, which eventually impedes or prevents removal of the production fluids through gas lifting techniques. Traditionally, water is removed by purging the well with nitrogen. Purging is typically performed by inserting coil tubing into the jointed gas lift tube which coil tubing includes a one-way valve situated at the lower or distal end thereof. Nitrogen gas is discharged through the valve which exits the coil tubing at a sufficient pressure and rate to purge the undesirable water from the annulus. This purge permits the formation or production fluids to enter the annulus through the casing perforations for lifting to the surface.

While this technique has proven sufficient to remove water from the well column, the costs associated with operation can escalate. This is primarily due to the amount of nitrogen gas which must be discharged from the coil tubing, which is substantial. Other gases may be employed for purging but nitrogen is inert and available.

In some instances, a more cost-effective approach than the use of nitrogen purging can be used. A hydraulic or down-hole jet pump can be lowered into the well casing to pump water and/or production fluid from the column. Due to the small diameter tubing of some gas lift installations, however, a small diameter jet pump would be required to be inserted into the gas lift tube. Such pumps are not widely available. Larger diameter jet pumps could be deployed by removing the gas lift tubing, but this approach is impractical due to cost of removal and re-deployment of the gas lift tubing.

Hydraulic or down-hole jet pumps are often favored over mechanical-type pumps in situations such as de-watering of wells or production fluid pumping. Briefly, jet pumps generally include a power fluid line operably coupled to the entrance of the jet pump, and a return line coupled to receive fluids from a discharge end of the pump. As the pressurized power fluid is forced, by a pump at the surface, down through the down-hole jet pump, the power fluid draws in and intermixes with the production fluid. The power fluid and production fluid then are pumped to the surface through the return line, and the production fluid may then be recovered, together with the power fluid. Jet pumps are often advantageous since they generally involve substantially less moving parts than mechanical pumps, which increases their reliability. Typical of patented jet pumps are the pumps disclosed in U.S. Pat. Nos. 1,355,606; 1,758,376; 2,287,076; 2,826,994; 3,215,087; 3,887,008; 4,183,722; 4,293,283; 4,390,061; 4,603,735; and 4,790,376.

Recent developments, however, have favored the use of "free" jet pumps which enable removal of the jet pump body while retaining substantial portions of the coil tubing or jointed tubing intact in the well. The pump body can be installed for operation by pumping the body down the tubing, and it may be removed by reversing the flow of the power fluid. Hence, the "free" jet pump body may be adjusted, and/or replaced without requiring that the tubing be pulled from the well. Typical of these "free" jet pumps are the pumps disclosed in U.S. Pat. Nos. 4,658,693 and 5,083,609.

FIG. 1 illustrates a prior art high volume, "free" hydraulic jet pump 10 retrievable by reverse flow. Briefly, a coiled or jointed tubing 11 is deployed in a well casing 12 formed to slidably receive a jet pump body 13 in column 14. A bottom hole assembly 15 is mounted to a lower end of tubing 11, which is secured to well casing 12 through a packer 16 to seal casing column 14. In operation, after passage down through tubing 11, jet pump body 13 is formed to slidably seat in a vertical cavity 17 provided in bottom-hole assembly 15. A standing valve 18, situated at a lower end of jet pump 10, permits passage of production fluid therethrough into a bottom hole annulus 20 formed between the pump body and the walls forming the vertical cavity. As the pressurized power fluid in tubing 11 is forced through a jet pump nozzle 22, it intermixes with the production fluid through entrances 23 and is injected through diffuser 24 and discharged out port 25 into well casing annulus 26 for passage upwardly to the surface and retrieval.

As mentioned, these jet pumps are relatively low maintenance partially due to their lack of moving parts. One area of weakness or region of failure, however, is the O-ring or fluid seals 27, 27', 27" and 27''' carried by pump body 13 which seals cooperate with the pump body and the bottom-hole assembly housing to separate the individual intake and discharge compartments. As illustrated in the jet pump of FIG. 1, at least four O-ring seals 27, 27', 27" and 27''' are provided which form a fluid-tight seal against the interior wall 28 forming bottom-hole assembly vertical cavity 17. These fluid seals, separating the adjacent compartments, must be of sufficient integrity to withstand the high pressures generated by power fluid and the discharged production fluids.

This integrity, however, is sometimes compromised as the outward facing orientation of the fluid seals expose them to contact with the interior walls 29 of the tubing 11 as the jet pump passes therethrough. Moreover, as the jet pump seats in the vertical cavity 17 of bottom-hole assembly 15 to separate the intake and discharge compartments, the three bottommost O-ring seals 27, 27', 27" and 27''' must traverse at least one, and as many as three, other seal point 30, 30', 30" and 30''' before forming a seal with the corresponding seal wall. This sliding contact degrades the seal integrity which may cause leakage in time. This, of course, results in pump down-time, as well as, maintenance at more frequent intervals.

DISCLOSURE OF INVENTION

Accordingly, it is an object of the present invention to provide a downhole hydraulic pump apparatus which minimizes the number of O-ring or fluid seal contacts required during installation and removal of a "free" jet pump assembly.

It is another object of the present invention to provide a hydraulic pump apparatus and method which can be installed downhole through coiled tubing.

Another object of the present invention is to provide a small diameter hydraulic pump apparatus and method employable in existing gas lift wells, flowing wells, and non-flowing wells with minimal alteration.

Still another object of the present invention is to provide a downhole hydraulic pump apparatus and method which reduces the costs of de-watering a well.

It is a further object of the present invention to provide a hydraulic pump apparatus and method which is durable, compact, easy to maintain, and has a minimum number of components.

In accordance with the foregoing objects, the present invention includes a "free" hydraulic pump apparatus for a well completion which is capable of insertion into existing well tubing without requiring substantial modification or removal of the tubing. Further, the jet pump body of the hydraulic pump apparatus of the present invention minimizes the number fluid-tight seals required and orients the same in a manner resulting in increased pump reliability. The hydraulic pump apparatus includes an elongated tube adapted for insertion into the well casing. A bottom-hole assembly is mounted to the tube proximate a lower end thereof and includes an interior wall forming a vertical cavity and an upper inwardly facing pump receiving passage. Below the pump receiving passage is a discharge port having an outwardly facing sealing surface. The present invention further includes a "free" jet pump assembly formed for sliding receipt in the passageway of the tube, and having a pump body extending into the bottom-hole assembly cavity forming an annulus therebetween. The pump body includes a lower seal mounted to an inwardly facing surface of the jet pump assembly for sealing engagement with the discharge port outwardly facing sealing surface which, when the pump assembly is operationally seated, permits discharge of exhausted production fluid from the jet pump assembly through the discharge port. Moreover, the arrangement of the lower seal and the inwardly facing discharge port sealing surface of the present invention shield the lower seal from contact with the tube and the inwardly facing bore sealing surface during said sliding receipt.

A method of the present invention for mating a "free" jet pump assembly with a bottom-hole assembly mounted to a lower end of a elongated tube inserted into a casing of a well completion to produce a production fluid from a formation is comprised, briefly, of the steps of: mounting to a bottom end of an elongated tube a bottom hole assembly having an inwardly facing pump receiving passage and a discharge port below the pump receiving passage. The port includes an outwardly facing sealing surface thereon. Thereafter, passing a jet pump assembly, having a lower seal mounted to an inwardly facing surface of the jet pump assembly, down the tube and into sealed engagement With the discharge port. During the passing step, the lower seal and the jet pump inwardly facing surface cooperate to shield the seal contact with the tube and the inwardly facing sealing bore portion.

Another aspect of the method of the present invention is to provide for de-watering or producing of a downhole well assembly disposed in the tubular casing of the well assembly. A relatively small diameter coiled tube hydraulic jet pump apparatus is used, and the method is comprised, briefly, of the steps of: inserting the coiled tube and the bottom hole assembly mounted on an end thereof into a column of the gas lift assembly until at least a portion of the bottom hole assembly is submerged in the fluids and seated in a packer. Thereafter, passing a jet pump assembly through a passageway of the coiled tube, and into a vertical cavity provided by the bottom-hole assembly for sealed engagement with a discharge port of the bottom-hole assembly terminating at the vertical cavity. Operation of the jet pump assembly then discharges the fluids therefrom through the discharge port.

BRIEF DESCRIPTION OF THE DRAWING

The assembly of the present invention has other objects and features of advantage which will be more readily apparent from the following description of the Best Mode of Carrying out the Invention and the appended claims, when taken in conjunction with the accompanying drawing, in which:

BEST MODE OF CARRYING OUT THE INVENTION

Figure 1:
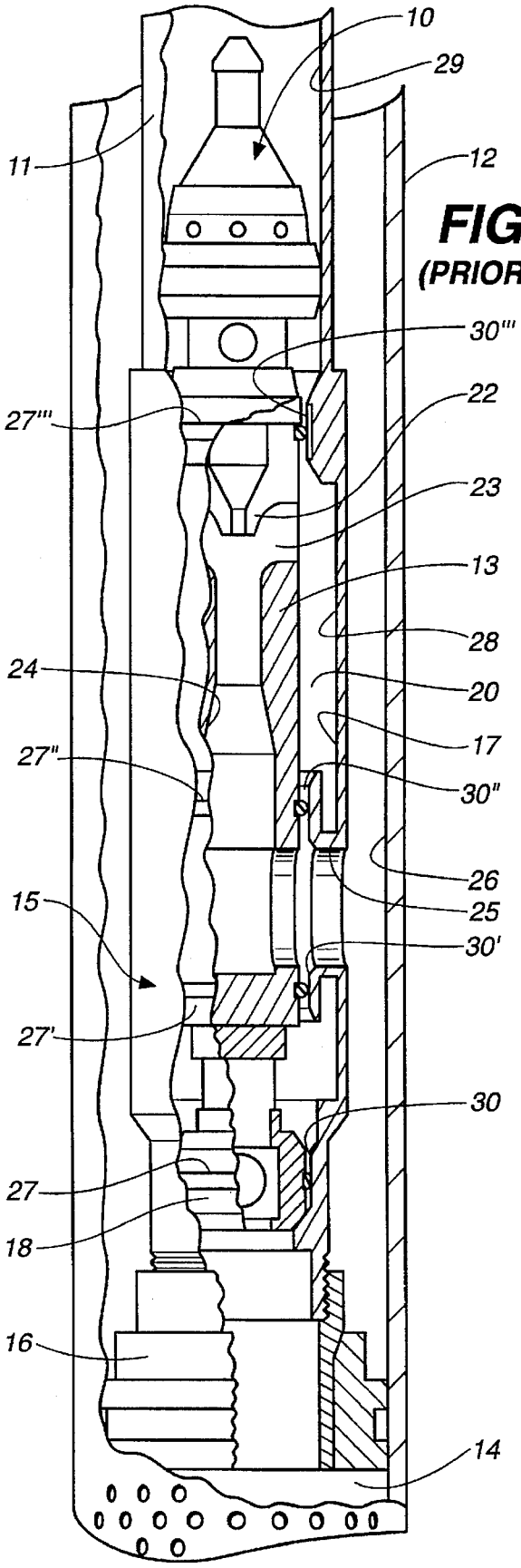
FIG. 1 (PRIOR ART)
FIG. 1 is a fragmentary, side elevation view, partially broken away, of a prior art high volume "free" jet pump installed in a well casing.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
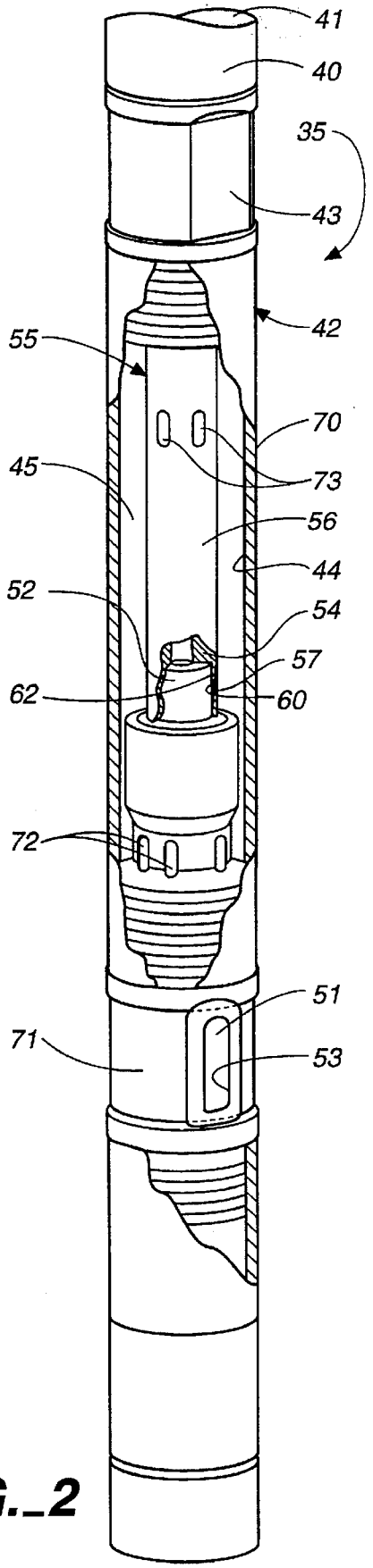
FIG. 2 is a fragmentary, side elevation view, partially broken away, of the hydraulic jet pump apparatus constructed in accordance with the present invention.
Figure 3:
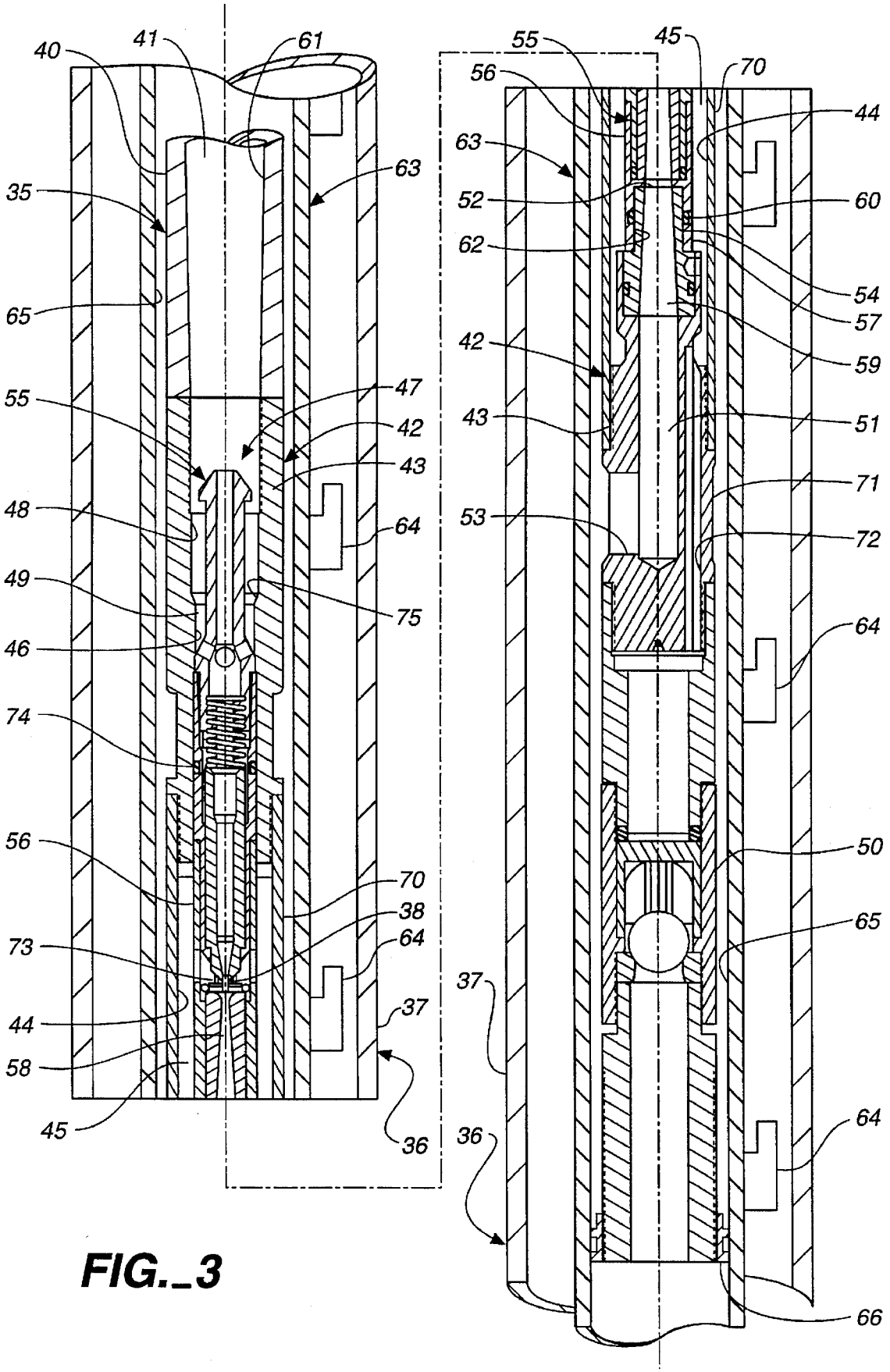
FIG. 3 is an enlarged, fragmentary side elevation view, in cross-section, of the hydraulic jet pump apparatus of FIG. 2.
Figure 4:
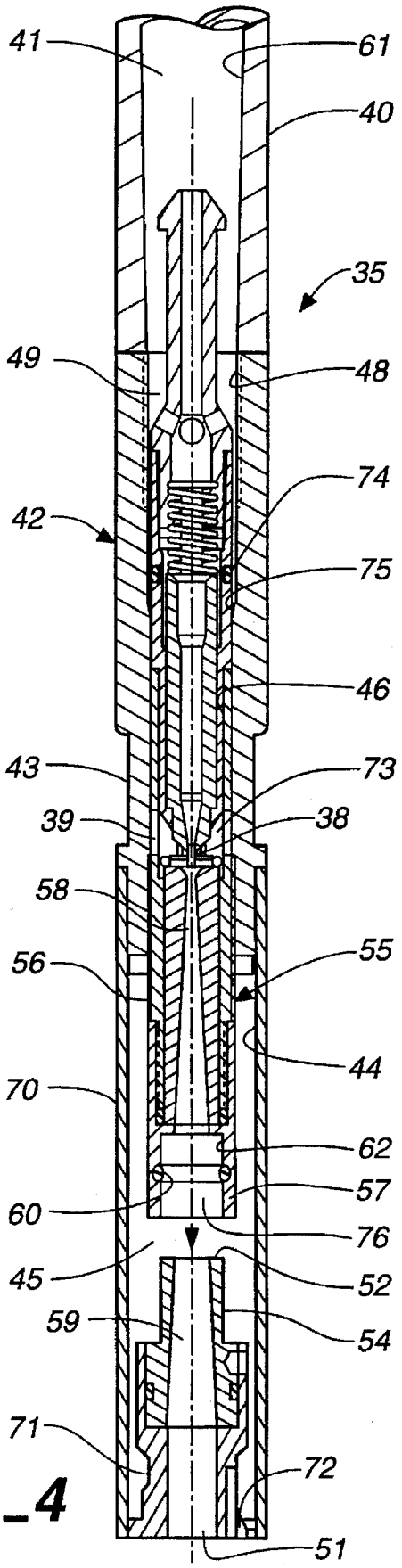
FIG. 4 is a fragmentary side elevation view, in cross-section, of the hydraulic pump apparatus of FIG. 2 illustrating coupling of the "free" jet pump assembly to a bottom hole assembly.

The present invention provides a downhole hydraulic pump apparatus and method which eliminates many of the problems associated with the prior art assemblies. FIGS. 2–4 illustrate the present hydraulic pump apparatus, generally designated 35, which is formed to be employed in a well completion or assembly 36 (FIG. 3) including a rigid, elongated tubular casing 37 extending into a formation containing a production fluid. Hydraulic jet pump apparatus 35 includes an elongated tube 40 adapted for selective insertion into casing 37 which has a longitudinal passageway 41 extending therethrough. A bottom-hole assembly, generally designated 42, is mounted to a lower end of tube 40. FIG. 3 illustrates that bottom-hole assembly 42 includes an adapter housing 43 with a downwardly extending tubular member 44 mounted thereto and forming a lower vertical cavity 45. Housing 43 forms a pump receiving passage 47 having an upper interior surface 48 forming an upper guide passage 49, and a lower inwardly facing sealing surface 46 forming a lower seating passage 39. Receiving passage 47 provides communication between tube passageway 41 and with lower vertical cavity 45. A standing valve 50 is situated at a lower end of adapter housing 43 which allows the passage of production fluid into vertical cavity 45. Bottom-hole assembly 42 includes a discharge port, generally designated 51, having an entrance end 52 and an exit end 53. The entrance end is formed with an outwardly facing sealing surface 54, best seen in FIG. 4.

A "free" jet pump assembly, generally designated 55, is included which is formed for sliding receipt in tube passageway 41 and the cavities of the bottom-hole assembly. Jet pump assembly 55 includes an elongated pump body 56 which is formed to extend into lower vertical cavity 45 to form a pump annulus between the outer pump body and the bottom-hole assembly inner lower wall 44 as the jet pump assembly is moved from the position of FIG. 4 to the position of FIG. 3 to operationally seat in the bottom-hole assembly. A port mounting portion 57 is positioned at a distal end of pump body 56 which is formed for mating cooperation with discharge port entrance end 52 of the bottom-hole assembly.

The pump body includes a lower seal 60 mounted to an inwardly facing surface 62 of the jet pump mounting portion 57 for sealing engagement with outwardly facing sealing surface 54 of entrance end 52. Accordingly,. when jet pump assembly 55 is operationally seated, discharge of exhausted power and production fluid from the jet pump assembly passes through discharge port 51 and into either a well annulus formed between well casing 37 and bottom-hole assembly 42 (when directly inserted in the well casing (not shown)), or a discharge annulus formed between a gas lift column 65 (FIG. 3) and bottom-hole assembly 42 (to be described in greater detail below).

FIGS. 3 and 4 illustrate that only one lower seal is provided between the mounting portion and the entrance end of the discharge port to effect a fluid seal of the vertical cavity from the discharge port. The addition of one or more O-ring seals to lower seal 60, in side-by-side relation, could be done, but such additional seals would be present to provide redundancy. In the preferred form, however, one seal is generally sufficient.

In accordance with the present invention, an exposed surface of lower seal 60 (FIG. 4) faces inwardly which is, thus, shielded from contact with the tube interior surface 61, sealing surface 46 and the interior surface of lower wall 44 of the bottom-hole assembly, during passage of the jet pump assembly 55 through tube 40 and bottom hole assembly 42. Accordingly, the first contact that lower O-ring 60 experiences is upon mating contact with the outwardly facing sealing surface 54 of the discharge port exit end 52. This minimizes the degradation affects of premature and adverse contact with other surfaces of hydraulic pump apparatus 35 as jet pump assembly 55 descends through tube 40 and bottom-hole assembly during installation and prior to coupling of the jet pump assembly to the discharge port exit end.

Accordingly, the hydraulic pump apparatus of the present invention has the advantage of reducing the number of seals required to seal to the bottom hole assembly and reorienting the seal, which, in turn, reduces the possibility of O-ring seal failure. Hence, the retrievable jet pump assembly has increased operational reliability.

In the preferred form of the present invention, the bottom-hole assembly is mounted to the distal end of coiled tubing 40. Briefly, coiled tubing, well known in the field, is capable of being stored on a large portable spool which permits unwinding of a single, continuous length of tubing without requiring the assembly of jointed units. It will be appreciated, however, that the bottom-hole assembly and "free" jet pump assembly of the present invention may be coupled to and installed through jointed tubes without departing from the true spirit and nature of the present invention.

One important benefit of the present invention is that the seal and bottom hole arrangement enables the construction of small diameter bottom-hole assemblies, "free" jet pump assemblies and associated coiled tubes which are capable of being inserted into or retrofit with existing well installations, such as gas lift tubes. As best illustrated in FIG. 3, gas lifting assemblies 63, having gas lift mandrels 64, can be used for de-watering economically and efficiently by simply inserting the small diameter hydraulic pump apparatus of the present invention (via., unwinding the coiled tube) into the gas lift column 65 to hydraulically pump the undesirable production fluids from well column. Hence, the gas lifting installation can be de-watered by pumping rather than employing the costly nitrogen gas discharge technique. Moreover, de-watering can be accomplished without removal of the gas lifting assembly to employ a hydraulic pump.

Briefly, coiled tube 40 having bottom-hole assembly 42 mounted on the end thereof is unwound in gas lift tube 40 to the proper depth, or to mount to a packer device 66 or the like. It will be appreciated that when packers are not employed, discharge port 51 may be communicably coupled to a return line (not shown) which extends to the top surface for production fluid recovery.

Referring now to FIGS. 3 and 4, it can be viewed that adapter housing 43, forming pump receiving passage 47, is removably mounted to coil tube 40 at an upper end, and is mounted to an outer tube 70 at a lower end thereof. Outer tube 70, in turn, is mounted to a middle plug 71, providing discharge port 51, which is then mounted to standing valve 50.

After installment of the bottom-hole assembly and the tubing, jet pump assembly 55 is passed through tube passageway 41 for operational mating with bottom-hole assembly 42. During operation as the jet pump assembly forces the power fluid through the jet pump body and out the discharge port, the production fluid is drawn into bottom-hole assembly 42 through standing valve 50, where it passes through a plurality of intake bores 72 spaced about discharge port 51 of middle plug member 71 (FIGS. 2 and 3). As the pressurized power fluid in tubing 40 is forced through a jet pump nozzle, it intermixes with the production fluid entering and drawn into jet pump body 56 through intake entrances 73 communicating with the annulus. These mixed fluids then pass through a a throat portion 58 of the jet pump, and through a diffuser portion 59 where they exit out a side of bottom-hole assembly 42 (i.e., middle plug 71) through discharge port 51.

During the installation of jet pump assembly 55 for operation, the preferably cylindrical-shaped pump body 56 is funneled into the guide passage 49 of pump receiving passage 47 formed and dimensioned for sliding receipt of the exterior surface of pump body 56. As pump body 56 enters vertical cavity 45, the annulus is formed between lower wall 44 of outer tube 70 of bottom-hole assembly 42 and the pump body exterior surface since a transverse cross-sectional dimension of vertical cavity 45 is larger than a transverse cross-sectional dimension of passageway 41 or pump receiving passage 47.

At least one upper seal 74 is situated between an exterior surface of jet pump assembly 55 and inwardly facing upper interior surface 48 of upper guide passage 49. Upper seal 74 forms a fluid-tight seal separating vertical cavity 45 from tube passageway 41 at a position above cavity 45. FIG. 3 illustrates that an a lower portion of interior surface 48 of housing 43 includes an tapered shoulder portion 75 tapering inwardly to join sealing surface 46 of lower seating passage 39. Sealing surface 46 is of a diameter sufficient to compress upper seal 74, preferably an O-ring, to form a fluid-tight seal between the pump body and the upper interior surface 46. Hence, as pump body 56 slides into upper guide passage 49, upper O-ring seal 74, retained in an annular groove in pump body 56, slidably engages shoulder portion 75 compressing the O-ring seal to separate vertical cavity 45 from tube passageway 41. It will be understood that a multiple or series of side-by-side upper O-rings could be included without departing from the true spirit and nature of the present invention to separate the adjoining passageway and cavity.

Preferably, mounting portion 57 includes a receiving bore 76 (FIG. 4) adapted to receive discharge entrance end 52 protruding into vertical cavity 45. Entrance end 52 is formed and dimensioned as a cylindrical-shaped post member having an outwardly facing sealing surface 54 which interengages inwardly facing surface 62 of the mounting portion to compress the O-ring lower seal 60. FIG. 4 best illustrates that lower seal 60 is retained in an annular groove formed in the inwardly facing surface of mounting portion 57 forming receiving bore 76. Similar to upper seal 74, lower seal 60 compresses to form a fluid-tight seal between vertical cavity 45 and discharge port 51. While the outwardly facing sealing surface is preferably cylindrical shaped, entrance end 52, as well as receiving bore 76, could also be conical-shaped.

From the description of the present apparatus, it will be understood that the method for mating "free" jet pump assembly 55 with bottom-hole assembly 42 positioned downhole in well assembly 36 to produce a production fluid from a formation comprises the steps of: mounting to a bottom end of an elongated tube 40 bottom hole assembly 42 having an inwardly facing pump receiving passage 47 and discharge port 51 below the pump receiving passage. Thereafter, passing a jet pump assembly 55 down tube 40 and into sealed engagement with discharge port 51 whereby lower seal 60 is shielded from contact with tube 40 and inwardly facing pump receiving passage 47 during the passing step.

The passing step is accomplished by inserting entrance end 52 of discharge port 51 into receiving bore 76 which is formed and dimensioned for receipt of the entrance end therein. In addition, the passing step further includes forming a fluid-tight seal between pump receiving passage 47 and jet pump assembly 55, when seated in vertical cavity 45, by slidably engaging upper seal 74, mounted to an upper portion of jet pump assembly 55, therebetween.

Before the passing step, inserting coiled tube 40 into well casing 37 until at least a portion of bottom-hole assembly 42 is submerged in the production fluid contained in the well casing.

Further, from the description of the present apparatus, it will be understood that the method for de-watering downhole well assembly 36 with a relatively small diameter coiled tube hydraulic pump apparatus comprises the steps of: inserting coiled tube 40 and bottom hole assembly 42 mounted on an end thereof into a column of gas lift assembly 63 disposed in tubular casing 37 until at least a portion of bottom hole assembly 42 is submerged in undesirable fluids retained in the well casing for removal thereof. Thereafter, passing jet pump assembly 55 through passageway 41 of coiled tube 40, and into vertical cavity 45 provided by bottom-hole assembly 42 for sealed engagement with a discharge port of bottom-hole assembly 42 terminating at vertical cavity 45. Operation of jet pump assembly 55, hence, discharges the fluids therefrom through discharge port 51.

What is claimed is:

1. A method of mating a "free" jet pump assembly with a bottom-hole assembly positioned downhole in a well assembly to produce a production fluid from a formation, the bottom-hole assembly being mounted to a lower end of an elongated tube inserted into a casing of said well assembly, the method comprising the steps of:

(A) mounting to a bottom end of an elongated tube a bottom hole assembly having an inwardly facing interior surface defining a pump assembly receiving passage and a discharge port below said receiving passage, said port having an outwardly facing sealing surface thereon;

thereafter, (B) passing a jet pump assembly, having a nozzle portion, a throat portion, an inwardly facing surface defining a receiving bore and a lower seal mounted to said inwardly facing surface thereof, down a passageway of said tube;

thereafter, (C) moving said jet pump assembly into said bottom-hole assembly to position said lower seal into sealed engagement with said discharge port, while said tube and said bottom-hole assembly remain positioned down-hole in said casing;

(D) shielding said lower seal from contact with said tube and said receiving passage during both step (B) and step (C) by retaining said lower seal in said receiving bore.

2. The method according to claim 1 wherein, step (C) is accomplished by inserting an entrance end of said discharge port, providing said outwardly facing sealing surface, into a receiving bore, defined by the pump assembly inwardly facing surface and formed and dimensioned for receipt of said entrance end therein to provide said sealed engagement.

3. The method according to claim 2 wherein, said entrance end protrudes into a vertical cavity, below said receiving passage, having a transverse cross-sectional area larger than a transverse cross-sectional area of said receiving passage such that an annulus is formed between said jet pump assembly and an interior wall defining said vertical cavity.

4. The method according to claim 1 wherein, step (C) further includes forming a fluid-tight seal between the receiving passage interior surface and said jet pump assembly by slidably engaging an upper seal, positioned proximate an upper portion of said jet pump assembly, therebetween.

5. The method according to claim 1 wherein, said elongated tube is provided by coiled tube; and before said passing step and said moving step, inserting said coiled tube into the well casing until at least a portion of said bottom-hole assembly is submerged in the production fluid contained in said well casing.

6. The method according to claim 1 further including the step of:

after step (C), selectively retrieving said pump assembly from said bottom-hole assembly, through hydraulic lifting, while said tube and said bottom-hole assembly remain positioned down-hole in said casing.

7. A method of de-watering a down-hole well assembly, having a gas lift assembly disposed in an elongated tubular casing of said well assembly extending into a formation producing production fluid, with a relatively small diameter coiled tube hydraulic pump apparatus, the method comprising the steps of:

(A) inserting the coiled tube and a bottom hole assembly mounted on an end thereof into a column of the gas lift assembly until at least a portion of said bottom hole assembly is submerged in undesirable fluids retained in the well casing for removal thereof;

thereafter, (B) passing a jet pump assembly having a nozzle and a throat portion through a passageway of said coiled tube; and thereafter, (C) moving said jet pump assembly into a vertical cavity provided by said bottom-hole assembly for sealed engagement with a discharge port of said bottom-hole assembly, while said tube and said bottom-hole assembly remain positioned down-hole in said casing, said discharge port terminating at said vertical cavity such that operation of said jet pump assembly discharges said fluids therefrom through said discharge port, further including the step of:

before step (A), (D) mounting to a bottom end of said coiled tube said bottom hole assembly further including an inwardly facing receiving passage above said discharge port and said vertical cavity, said port having an outwardly facing sealing surface thereon; and step (C) is further accomplished by mating an inwardly facing surface of said jet pump assembly, defining a receiving bore and having a lower seal mounted thereto, with the discharge port outwardly facing sealing surface providing said sealed engagement; and (E) shielding said lower seal from contact with said tube and said receiving passage during both step (B) and step (C) by retaining said lower seal in said receiving bore.

8. The method according to claim 7 wherein, step (C) further includes forming a fluid-tight seal between said receiving passage and said jet pump assembly by slidably engaging an upper seal, mounted proximate an upper portion of said jet pump assembly, therebetween.

9. The method according to claim 7 further including the step of:

after step (C), selectively retrieving said pump assembly from said bottom-hole assembly, through hydraulic lifting, while said tube and said bottom-hole assembly remain positioned down-hole in said casing.

10. A hydraulic pump apparatus for a well assembly including a rigid, elongated tubular casing extending into a formation producing production fluid, said hydraulic pump apparatus comprising:

an elongated tube having a passageway;

a bottom-hole assembly mounted proximate a lower end of said tube, said tube and said bottom-hole assembly both being adapted for selective insertion into said casing, said bottom-hole assembly having a discharge port and an outwardly facing sealing surface above said discharge port; and a "free" jet pump assembly including a pump body having a nozzle portion and a throat portion, and formed for selective sliding receipt in and removal from the tube passageway and said bottom-hole assembly, through hydraulic lifting, while said tube and said bottom-hole assembly remain positioned down-hole in said casing, said pump body further having an inwardly facing surface defining a receiving bore and a lower seal mounted to said inwardly facing surface for sealing engagement with said outwardly facing sealing surface of said bottom-hole assembly when said jet pump assembly is selectively received therein to permit discharge of exhausted production fluid from said jet pump assembly through said discharge port, said lower seal further being received in said receiving bore of said inwardly facing surface to shield said lower seal from contact with said tube during said sliding movement of said jet pump assembly down said tube and into sealed engagement with said bottom-hole assembly.

11. The hydraulic pump apparatus as defined in claim 10 wherein, said bottom-hole assembly includes an interior surface defining a pump receiving passage formed for said selective sliding receipt and removal of said pump assembly, said receiving passage being positioned above said discharge port and said sealing surface, and an entrance end of said discharge port terminates at a vertical cavity of said bottom-hole assembly and below said receiving passage, said cavity having a transverse cross-sectional area larger than a transverse cross-sectional area of said receiving passage such that an annulus is formed between said pump body and an interior wall defining said vertical cavity to communicate said production fluid with the pump nozzle.

12. The hydraulic pump apparatus as defined in claim 11 wherein, said outwardly facing sealing surface forms a cylindrical post member extending into said vertical cavity, and said receiving bore is formed and dimensioned for sliding receipt of said post member.

13. The hydraulic pump apparatus as defined in claim 12 wherein, said sealing engagement of said lower seal forms a fluid-tight seal of said vertical cavity from said discharge port.

14. The hydraulic pump apparatus as defined in claim 12 further including:

an upper seal situated proximate an upper end of said pump body in sealing engagement between said upper pump body and the interior surface forming said receiving passage to fluid-tight seal said vertical cavity from said tube passageway upon said sealing engagement of said lower seal.

15. The hydraulic pump apparatus as defined in claim 14 wherein, said upper seal is an O-ring, and said pump body is cylindrical shaped and includes an upper annular slot retaining the upper O-ring therein.

16. The hydraulic pump apparatus as defined in claim 11 wherein, said pump body includes an intake entrance for introducing the production fluid in said vertical cavity into said pump body for mixing with a power fluid passing through the pump and discharged through said discharge port.

17. The hydraulic pump apparatus as defined in claim 10 wherein, said tube is provided by coil tubing.

18. The hydraulic pump apparatus as defined in claim 10 wherein, said lower seal is provided by an fluid seal, and said inwardly facing surface defines an annular slot formed for mounting receipt of said fluid seal.

19. The hydraulic pump apparatus as defined in claim 10 wherein, a standing valve is mounted on a distal end of said bottom-hole assembly, and an exit end of said discharge port is situated on a side-portion thereof above said standing valve.

20. A hydraulic pump apparatus for a well assembly including a rigid, elongated tubular casing extending into a formation producing production fluid, said hydraulic pump apparatus comprising:

an elongated tube adapted for selective insertion into said casing and defining a passageway extending longitudinally therethrough;

a bottom-hole assembly mounted to said tube proximate a lower end thereof and adapted for insertion into said casing, said bottom-hole assembly having a lower interior wall defining a vertical cavity along a portion thereof communicating with said passageway, and having a transverse cross-sectional dimension larger than a transverse cross-sectional dimension of said passageway, said bottom-hole assembly including a standing valve communicating with said cavity, and a discharge port having an entrance end terminating at said cavity and an exit end exiting out said bottom-hole assembly; and a "free" jet pump assembly including a pump body having a nozzle portion, a throat portion and production fluid intake entrances at side portions thereof in communication with said nozzle portion and said throat portion, and formed for selective sliding receipt in and removal from said passageway and said bottom-hole assembly, through hydraulic lifting, while said tube and said bottom-hole assembly remain positioned downhole in said casing, said pump body extending into the bottom-hole assembly cavity forming an annulus therebetween to provide a conduit for passage of production fluid therethrough into fluid communication with said intake entrances, and having a port mounting portion positioned at a distal end thereof formed for mating cooperation with said entrance end of said discharge port to provide fluid communication between the pump assembly nozzle and said discharge port, said jet pump assembly further including at least one upper seal, situated between said jet pump assembly and an upper interior wall of said bottom-hole assembly, for fluid-tight sealing said cavity from said passageway at a position above said cavity, and at most one non-redundant lower seal in fluid-tight sealing engagement between said mounting portion and said entrance end, the upper seal and the lower seal being formed when said jet pump assembly is selectively received in said bottom-hole assembly, said mounting portion further dimensioned to support and orient said lower seal out of sliding engagement with one of said tube, said upper interior wall and said lower interior wall during sliding movement of said jet pump assembly therethrough.

21. The hydraulic pump apparatus as defined in claim 20 wherein, said tube is provided by coil tubing.

22. The hydraulic pump apparatus as defined in claim 20 wherein, said entrance end is provided by a post member extending into said vertical cavity, and said port mounting end includes a bore formed and dimensioned for sliding receipt of said post member.

23. The hydraulic pump apparatus as defined in claim 22 wherein, said lower seal is provided by an fluid seal, and said port mounting end includes an annular slot formed for receipt of said fluid seal.

24. The hydraulic pump apparatus as defined in claim 20 wherein, said standing valve is mounted on a distal end of said bottom-hole assembly, and said exit end is situated on a side-portion thereof above said standing valve.

* * * * *

UNITED STATES PATENT AND TRADEMARK OFFICE

CERTIFICATE OF CORRECTION

PATENT NO. : 5,651,664

DATED : July 29, 1997

INVENTOR(S) : HINDS et al.

It is certified that error appears in the above-identified patent and that said Letters Patent is hereby corrected as shown below:

On the cover sheet, at [57], line 2 of the ABSTRACT, immediately following "(37)", delete the period.

At column 1, line 23, delete "atypical" and insert therefor --a typical--.

At column 4, line 23, delete "With" and insert therefor --with--.

At column 5, line 51, immediately following "Accordingly,", delete the period.

At column 7, line 7, immediately following "nozzle", insert --38--.

At column 7, line 30, delete "an a lower" and insert therefor --a lower--.

At column 7, line 35, delete "upper interior" and insert therefor --lower interior--.

Claim 1, column 8, line 55, immediately following "said casing;" insert --and--.

Claim 5, column 9, line 16, delete "said passing step and said moving step" and insert therefor --step (B) and step (C)--.

UNITED STATES PATENT AND TRADEMARK OFFICE

CERTIFICATE OF CORRECTION

PATENT NO. : 5,651,664

DATED : July 29, 1997

INVENTOR(S) : HINDS et al.

It is certified that error appears in the above-identified patent and that said Letters Patent is hereby corrected as shown below:

Claim 23, column 12, line 46, delete "an fluid" and insert therefor --a fluid--.

Signed and Sealed this

Seventeenth Day of November, 1998

*Attest:*

*Attesting Officer*

BRUCE LEHMAN

*Commissioner of Patents and Trademarks*